US008074306B2

(12) United States Patent
Chien et al.

(10) Patent No.: US 8,074,306 B2
(45) Date of Patent: Dec. 13, 2011

(54) ROTATABLE AND POSITIONABLE BATHING SEAT

(76) Inventors: Li-Sheng Chien, Taipei (TW); Chien-Chang Ho, Taipei County (TW)

( * ) Notice: Subject to any disclaimer, the term of this patent is extended or adjusted under 35 U.S.C. 154(b) by 406 days.

(21) Appl. No.: 12/493,190

(22) Filed: Jun. 27, 2009

(65) Prior Publication Data

US 2010/0325790 A1 Dec. 30, 2010

(51) Int. Cl.
*A47K 3/022* (2006.01)

(52) U.S. Cl. ..... 4/578.1

(58) Field of Classification Search ..... 4/578.1, 4/579

See application file for complete search history.

(56) References Cited

U.S. PATENT DOCUMENTS 6,681,415 B1 * 1/2004 Gallo ..... 4/560.1
7,661,154 B2 * 2/2010 Cheng ..... 4/560.1

* cited by examiner

*Primary Examiner* — Huyen Le
(74) *Attorney, Agent, or Firm* — WPAT, P.C.; Anthony King

(57) ABSTRACT

A rotatable and positionable bathing seat includes a rotating device and a positioning device between a cushion and a base. The rotating device includes an upper turntable connected to the bottom of the cushion, a lower turntable connected to the base, and balls between the upper and lower turntables. The lower turntable includes positioning holes. The positioning device includes a fixing plate connected to the bottom of the cushion, a press plate pivotally connected to the fixing plate, a pivoting portion disposed at the middle of the press plate and an end of the pivoting portion forming a force applying portion, and an elastic element installed between the force applying portion and the fixing plate, and another end of the pivoting portion passed into or separated from a positioning pin in the positioning hole, such that the bathing seat can rotate and position the cushion at the base.

8 Claims, 5 Drawing Sheets

ROTATABLE AND POSITIONABLE BATHING SEAT

FIELD OF THE INVENTION

The present invention relates to a rotatable and positionable bathing seat, in particular to an improved structure of a bathing seat that is installed at a selected position of a bath tub and used for assisting a physically disabled person to take a bath.

BACKGROUND OF THE INVENTION

As patients or the elderly have difficulties to enter and exit a bath tub, they usually rely on the assistance of a bathing seat and a nursing assistant for taking a bath, and the bathing seat has become one of the necessary nursing equipments. However, a traditional bathing seat is generally a fixed seat or a foldable stand with a size matched with the bath tub, wherein a cushion is coupled to the top of the stand, and the cushion comes with many drainage holes. The bathing seat is placed or fixed in the bath tub, so that the nursing assistant can help a patient or an elderly people to sit on the cushion in order to take a bath. The design of helping the patient or elderly to enter and exit the bath tub is still not taken into consideration in the traditional bathing seat, and thus patients and the elderly to rely on the nursing assistant's support or holding. Obviously, the use of such traditional bathing seat is inconvenient, and may even result in a serious consequence in a slippery bath room. As to other traditional bathing seats, some may come with a mechanical design to assist the patients or elderly to enter and exit the bath tub, yet the design is still not good enough or safe, and the traditional bath seats require improvements.

Therefore, it is a main subject of the present invention to design a bathing seat for assisting the patients or elderly to enter and exit the bath tub, so that the patients or elderly can take baths on their own or allow the nursing assistant to assist them to take a bath.

SUMMARY OF THE INVENTION

In view of the aforementioned shortcomings of the conventional bathing seat structure, the inventor of the present invention based on years of experience in the related industry to conduct extensive researches and experiments, and finally developed a rotatable and positionable bathing seat, so that the patients or the elderly can enter and exit the bath tub on their own or the nursing assistant can assist them to enter and exit bath tub more easily.

Therefore, it is a primary objective of the present invention to provide a rotatable and positionable bathing seat having an improved design with a rotating device and a positioning device installed between the bathing seat cushion and a base, such that the cushion can be rotated and positioned on the base, and the patient or the elderly person can sit on the cushion and turn into or out of the bath tub to achieve the effect of entering or exiting the bath tub, or allowing the nursing assistant to help them to enter and exit the bath tub more easily.

To achieve the foregoing objectives, the present invention provides a rotatable and positionable bathing seat comprising a cushion, a rotating device coupled to the bottom of the bathing seat, and a positioning device fixed onto a base for limiting the turning rotating device, characterized in that the rotating device includes an upper turntable coupled to the bottom of the cushion and a lower turntable coupled to the base, a spindle coupled between the upper turntable and the lower turntable, and a plurality of circularly arranged balls, and the lower turntable includes a plurality of circularly arranged positioning holes; and the positioning device includes a fixing plate coupled to the bottom of the cushion, and a press plate pivotally coupled to the fixing plate, and having a pivoting portion at the middle of the press plate, and an end of the pivoting portion forms a force applying portion, and another end of the pivoting portion forms a trigger portion, and the trigger portion is coupled to a positioning pin that can be passed into or separated from the positioning hole of the lower turntable, and an elastic element is coupled between the force applying portion and the fixing plate.

Therefore, a rotatable and positionable bathing seat of the present invention allows the patient or the elderly to sit on the cushion by fixing the base at a selected position of the bath tub and use the rotating device to enter into the bath tub for taking a bath or exit the bath tub after taking a bath. The positioning device is provided for fixing the cushion at a specific position, such that the patient or the elderly can take a bath, sit on the bathing seat or stand up from the bathing seat more safely.

DESCRIPTION OF THE PREFERRED EMBODIMENTS

Other features and advantages of the present invention will become apparent in the following detailed description of the preferred embodiments with reference to the accompanying drawings.

With reference to the figures for a rotatable and positionable bathing seat of a preferred embodiment of the present invention, the rotatable and positionable bathing seat comprises a rotating device 2 coupled to the bottom of a cushion 1, and a positioning device 3 for limiting a turn of the rotating device 2, and the rotating device 2 is fixed to a base 4.

Figure 1:
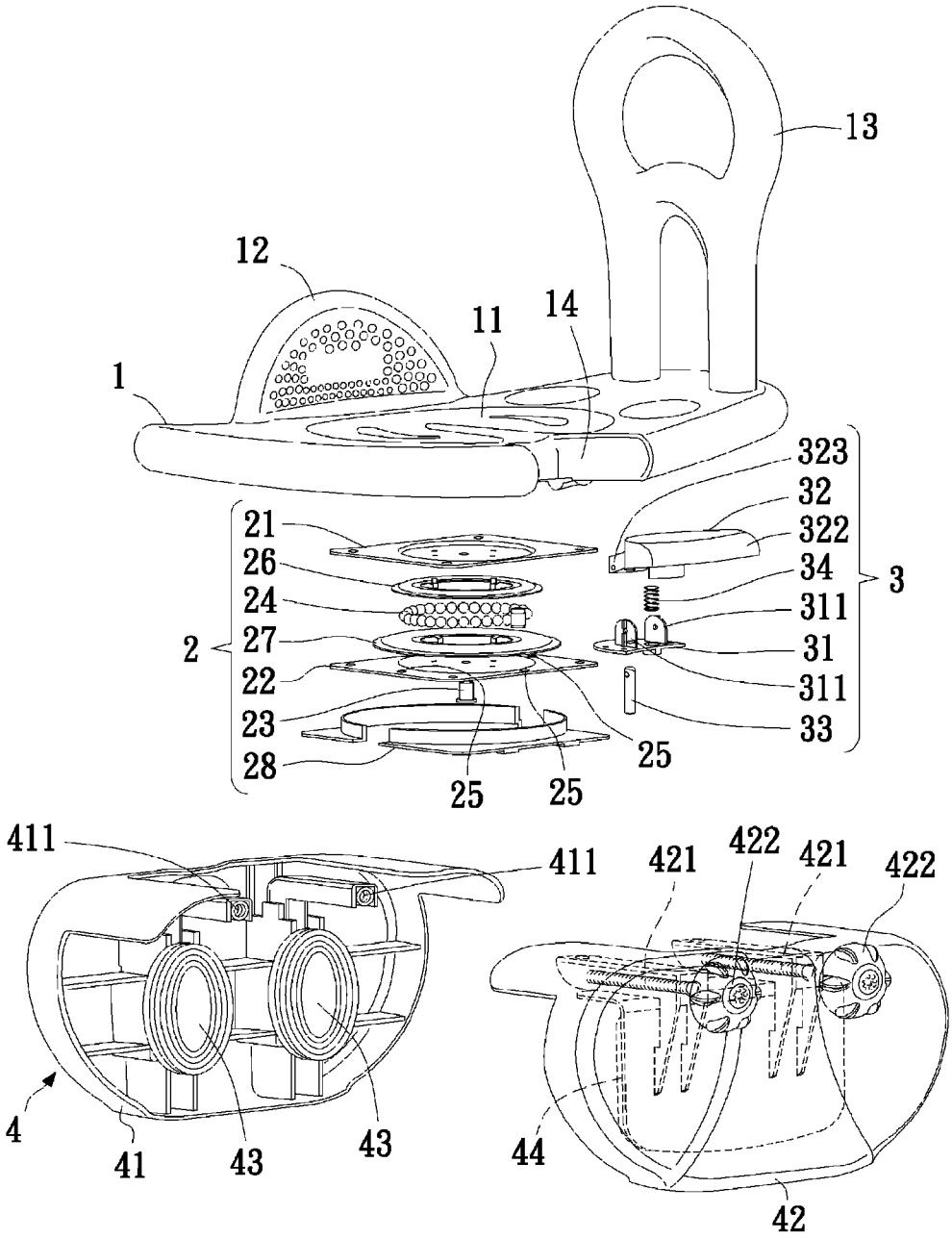
FIG. 1 is an exploded view of a preferred embodiment of the present invention.

The cushion 1 as shown in FIG. 1 comprises one or more slip resistant pads 11 coupled to the top of the cushion 1, a backrest 12 installed at a rear side of the cushion 1, a handrail 13 coupled to a lateral side of the cushion 1, and a notch 14 disposed at a front side of the cushion 1.

Figure 3:
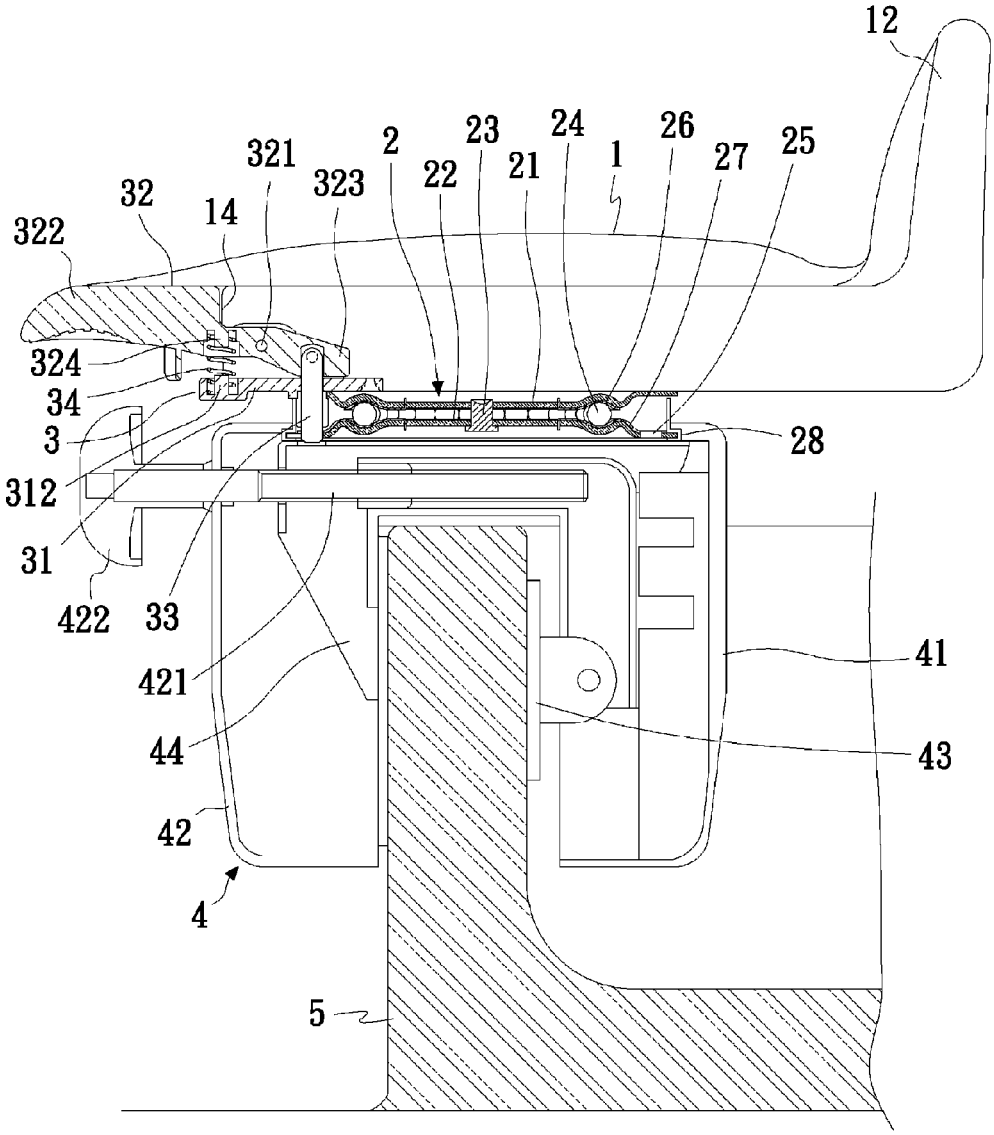
FIG. 3 is a cross-sectional view of a preferred embodiment of the present invention.

The rotating device 2 as shown in FIGS. 1 and 3 comprises an upper turntable 21 coupled to the bottom of the cushion 1 and a lower turntable 22 coupled to the top of the base 4, wherein the upper turntable 21 and the lower turntable 22 are in a rectangular, a circular or any other shape, and a spindle 23 is coupled to the middle of the turntables 21, 22, and a plurality of balls 24 are circularly arranged between the upper turntable 21 and the lower turntable 22, such that the upper turntable 21 and the lower turntable 22 can be slidably turned by the balls 24 and the lower turntable 22 includes a plurality of circularly arranged positioning holes 25. This preferred embodiment includes an upper ring 26 and a lower ring 27 coupled between the upper turntable 21 and the lower turntable 22, so that the plurality of balls 24 can be coupled between the upper ring 26 and the lower ring 27 and installed stably, and an outer ring 28 is coupled to the periphery of the rotating device 2 for preventing components including the upper turntable 21, the lower turntable 22 and the balls 24 from being exposed.

The positioning device 3 as shown in FIGS. 1 and 3 comprises a fixing plate 31 fixed to the bottom of the cushion 1, a pivoting base 311 individually bent from both sides of the fixing plate 31, and a press plate 32 pivotally coupled to the fixing plate 31 and having a pivoting portion 321 at the middle of the press plate 32, wherein an end of the pivoting portion 321 forms a force applying portion 322, and another end of the pivoting portion 321 forms a trigger portion 323, such that the pivoting portion 321 at the middle of the press plate 32 is coupled between the two pivoting bases 311 of the fixing plate 31, and the trigger portion 323 is passed into or separated from a positioning pin 33 of the positioning hole 25 of the lower turntable 225, and an elastic element 34 is coupled between the force applying portion 322 and the fixing plate 31, and the elastic element 34 can be a spiral compression spring or a metal elastic plate. This preferred embodiment includes a first protruding pillar 312 installed at the top of the fixing plate 31, and the force applying portion 322 of the press plate 32 includes a second protruding pillar 324 at the bottom of the force applying portion 322, such that the elastic element 34 is coupled between the first protruding pillar 312 and the second protruding pillar 324. The fixing plate 31 is coupled at a position proximate to the bottom of the cushion 1 notch 14, such that the force applying portion 322 of the press plate 32 can be contained into the notch 14 and provided for users to press conveniently.

Figure 2:
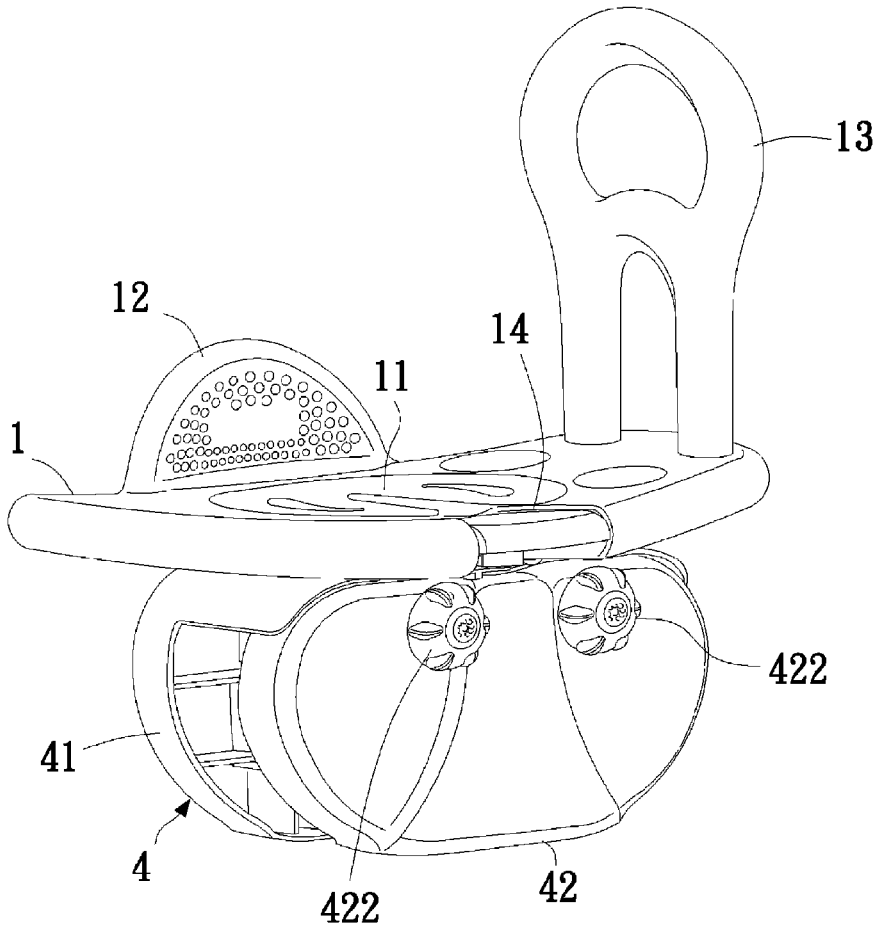
FIG. 2 is a perspective view of a preferred embodiment of the present invention.

The base 4 as shown in FIGS. 1 to 3 comprises a fixed base 41 and a moving base 42 corresponding with one another, and the fixed base 41 includes at least one screw hole 411 (wherein two screw holes 411 are shown in the figures) disposed on an internal side of the fixed base 41 and at least one fixed jaw 43 (wherein two fixed jaws 43 are shown in the figures). The moving base 42 includes at least one screw rod 421 passed from an external side of the moving base 42 and connected to the internal side of the screw hole 411, and an end of the screw rod 421 has a knob 422, and an internal side of the moving base 42 has a moving jaw 44 corresponding to the fixed jaw 43, so that the screw rod 421 can be turned to clamp the fixed jaw 43 and the moving jaw 44 onto sidewalls of the bath tub 5 to fix the whole base 4 to the bath tub 5.

Figure 4:
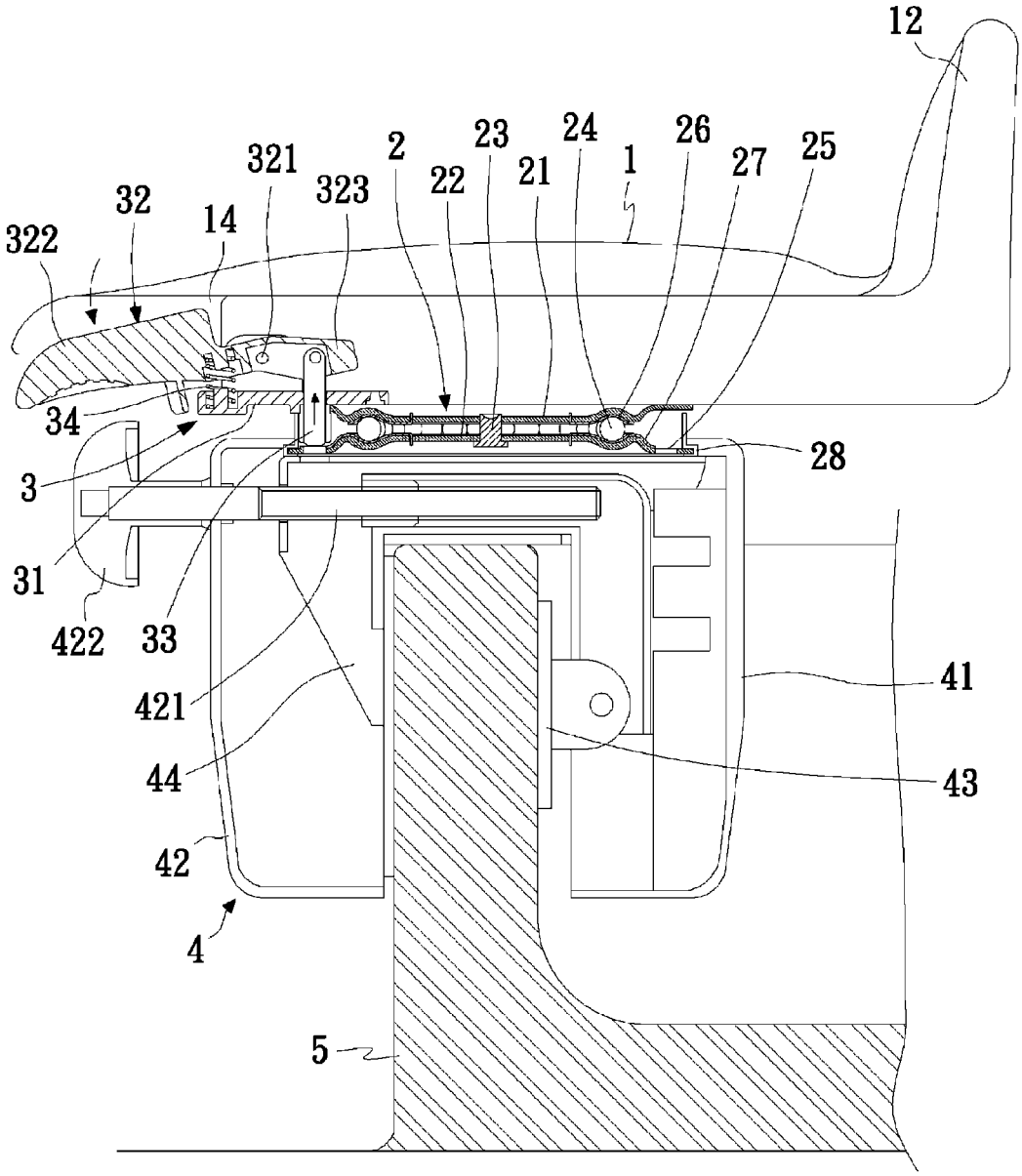
FIG. 4 is a schematic view of an application in accordance with a preferred embodiment of the present invention.
Figure 5:
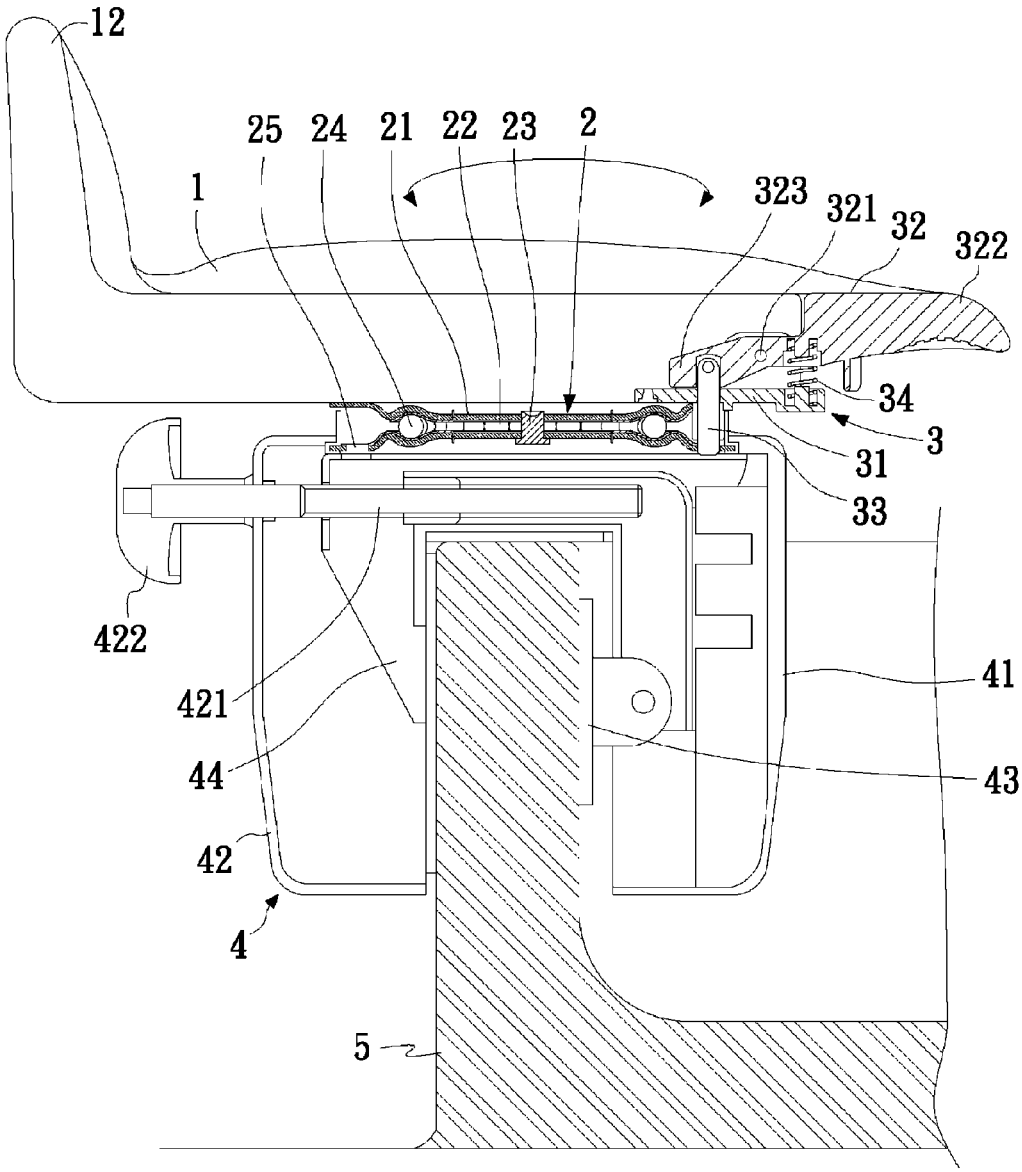
FIG. 5 is another schematic view of an application in accordance with a preferred embodiment of the present invention.

With the improved design of the rotatable and positionable bathing seat in accordance with the present invention, the application of the bathing seat allows the patient and the elderly to sit on the cushion 1 or the nursing assistant to assist them to sit on the cushion 1, and then press the force applying portion 322 of the press plate 32 of the positioning device 3 as shown in FIG. 4 to lift a trigger portion 323 at another end and the positioning pin 33, so as to separate the positioning pin 33 from the positioning hole 25 of the lower turntable 22, by the rotating device 2 and turn the cushion 1 through the structure of the upper and lower turntables 21, 22 and the balls 23 to turn the patient or the elderly into the bath tub 5. If the cushion 1 is turned to an appropriate position as shown in FIG. 5, the press plate 32 will return to its original position by the tension of the elastic element 34, while the positioning pin 33 is being passed into the positioning hole 25 of the lower turntable 22 again for positioning the cushion 1 and preventing the cushion 1 from being turned freely, such that the patient or the elderly can take a bath in the bath tub 5 safely. On the other hand, the aforementioned operation can be used to turn the patient or the elderly out of the bath tub 5, and the positioned cushion 1 and handrail 13 are provided for the patient or the elderly to stand up safely on their own or the nursing assistant can give a hand to the patient or the elderly to stand up and transfer the patient or the elderly to a wheelchair.

In summation of the description above, the improved design of the rotating device 2 and the positioning device 3 connected between the bathing seat cushion 1 and the base 4 allows the cushion to be turned and positioned on the base, so that the patient or the elderly can sit on the cushion 1 and turn into or out of the bath tub to achieve the effects of entering or exiting the bath tub on the own or with the assistance of the nursing assistant. Obviously, the present invention complies with the patent application requirements and the products produced according to the present invention can meet the current market requirements.

While the invention has been described by means of specific embodiments, numerous modifications and variations could be made thereto by those skilled in the art without departing from the scope and spirit of the invention set forth in the claims.

What is claimed is:

1. A rotatable and positionable bathing seat, comprising a rotating device coupled to the bottom of a cushion and fixed to a base, and a positioning device for limiting a turn of the rotating device, characterized in that:

the rotating device comprises an upper turntable coupled to the bottom of the cushion, a lower turntable coupled to the base, a spindle coupled between the upper turntable and the lower turntable and a plurality of circularly arranged balls, and the lower turntable includes a plurality of circularly arranged positioning holes;

the positioning device includes a fixing plate coupled to the bottom of the cushion, and a press plate pivotally coupled to the fixing plate, and having a pivoting portion at the middle of the press plate, and an end of the pivoting portion forms a force applying portion, and another end of the pivoting portion forms a trigger portion, and the trigger portion is coupled to a positioning pin that can be passed into or separated from the positioning hole of the lower turntable, and an elastic element is coupled between the force applying portion and the fixing plate.

2. The rotatable and positionable bathing seat of claim 1, further comprising an upper ring and a lower ring coupled between the upper turntable and the lower turntable of the rotating device, and the plurality of balls being coupled between the upper ring and the lower ring.

3. The rotatable and positionable bathing seat of claim 1, further comprising an outer ring coupled to the periphery of the rotating device.

4. The rotatable and positionable bathing seat of claim 1, comprising a pivoting base individually formed bending both sides of the fixing plate of the positioning device, and the pivoting portion at the middle of the press plate being coupled between the two pivoting bases of the fixing plate.

5. The rotatable and positionable bathing seat of claim 1, comprising a first protruding pillar installed at the top of the fixing plate of the positioning device, a second protruding pillar installed at the bottom of the force applying portion of the press plate, and the elastic element being a spiral compression spring coupled between the first protruding pillar and the second protruding pillar.

6. The rotatable and positionable bathing seat of claim 1, wherein the cushion includes a notch disposed at a front side of the cushion, and the fixing plate of the positioning device is coupled to the bottom proximate to the fixing plate, and the force applying portion of the press plate is contained into the notch.

7. The rotatable and positionable bathing seat of claim 1, wherein the cushion includes a slip resistant pad coupled to the top of the cushion, a backrest installed at a rear side of the cushion, and a handrail coupled to a lateral side of the cushion.

8. The rotatable and positionable bathing seat of claim 1, wherein the base comprises a fixed base and a moving base corresponding to one another, and the fixed base includes at least one screw hole disposed on an internal side of the fixed base and at least one fixed jaw pivotally coupled to the fixed base; and the moving base includes a screw rod connected to the screw hole of the fixed base, a knob installed at an end of the screw rod, and a moving jaw disposed on an internal side of the moving base and corresponding to the fixed jaw.

* * * * *